US006146673A

United States Patent [19]

Ferguson

[11] Patent Number: 6,146,673

[45] Date of Patent: Nov. 14, 2000

[54] BAKED GOODS CONTAINER

[76] Inventor: Kathy Ferguson, 3167 Nickelby, Shelby Township, Mich. 48316

[21] Appl. No.: 09/310,319

[22] Filed: May 12, 1999

Related U.S. Application Data

[63] Continuation-in-part of application No. 09/231,056, Jan. 14, 1999, which is a continuation of application No. 09/041,532, Mar. 12, 1998, Pat. No. 5,912,033.

[51] Int. Cl.[7] ..... B65D 21/00; B65D 1/22; B65D 25/10; B65D 57/00; B65D 85/36

[52] U.S. Cl. ..... 426/115; 426/119; 426/124; 426/128; 206/499; 220/529; 220/660

[58] Field of Search ..... 426/108, 110, 426/112, 115, 119, 124, 128; 206/486–489, 499; 220/529, 528, 660

[56] References Cited

U.S. PATENT DOCUMENTS

| | | | |
|---|---|---|---|
| D. 257,116 | 9/1980 | Lakatos et al. | D7/96 |
| D. 346,528 | 5/1994 | Crawford et al. | D7/357 |
| D. 348,378 | 7/1994 | Crane | D7/610 |
| D. 356,716 | 3/1995 | Dornbush et al. | D7/357 |
| D. 365,502 | 12/1995 | Runge | D7/610 |
| D. 400,055 | 10/1998 | McFadzean | D7/610 |
| 2,057,951 | 10/1936 | Ingram et al. | 53/6 |
| 3,620,403 | 11/1971 | Rump | 220/4 E |
| 3,633,786 | 1/1972 | Leedy | 220/23.2 |
| 3,756,681 | 9/1973 | Croston | 312/351 |
| 3,944,109 | 3/1976 | Holz | 220/20 |
| 4,200,346 | 4/1980 | Belokin, Jr. | 312/351 |
| 4,348,421 | 9/1982 | Sakakibara et al. | 426/394 |
| 4,583,955 | 4/1986 | Toloczko | 446/73 |
| 5,012,655 | 5/1991 | Chatterton | 62/340 |
| 5,048,506 | 9/1991 | Hayashi | 126/262 |
| 5,072,850 | 12/1991 | Gagnon et al. | 220/300 |
| 5,244,095 | 9/1993 | DeVoe | 206/575 |
| 5,421,459 | 6/1995 | Mazzotti | 206/549 |
| 5,450,785 | 9/1995 | Westbrooks | 99/426 |
| 5,597,073 | 1/1997 | Kocis | 206/564 |
| 5,632,924 | 5/1997 | Gics et al. | 249/111 |
| 5,706,966 | 1/1998 | Rothe | 220/23.83 |
| 5,868,269 | 2/1999 | Juarez | 220/529 |
| 5,910,162 | 6/1999 | Harbour et al. | 62/246 |
| 5,912,033 | 6/1999 | Ferguson | 426/124 |
| 6,003,671 | 12/1999 | McDonough et al. | 206/493 |

OTHER PUBLICATIONS

Advertisement for Ice Cream Cupcake Baking Pan on Side Panel of Joy Cone Bos, Date Unknown.

*Primary Examiner*—Keith Hendricks
*Assistant Examiner*—Drew Becker
*Attorney, Agent, or Firm*—Harness, Dickey & Pierce, P.L.C.

[57] ABSTRACT

A food storage and transportation device primarily including a container, a plurality of removable inserts, and a lid is described. The inner surface of the container has a plurality of support members disposed on and extending from the inner surface. The removable inserts have a plurality of grooves, a set of handles, and a plurality of openings for receiving a plurality of cupcakes. In one embodiment, the support member includes first and second shoulder portions for supporting the inserts. In another embodiment, the support member has a substantially uniformly increasing profile distance from the inner surface of the container as the support member extends downwardly from the upper portion to the lower portion of the container. The inserts are provided with grooves that frictionally engage the support member. In operation, the cupcakes are placed into the respective openings with the base of the cupcakes extending through the opening, whereas the top of the cupcake is retained above a top surface of the removable insert. The removable inserts and cupcakes are then loaded into the container. At no time does any cupcake come into contact with any other cupcakes. To remove the cupcakes, the removable insert is removed from the container and placed on a flat surface, whereupon the cupcakes are conveniently dislodged from their respective openings.

9 Claims, 5 Drawing Sheets

BAKED GOODS CONTAINER

CROSS-REFERENCE TO RELATED APPLICATIONS

This application is a continuation-in-part of U.S. patent application Ser. No. 09/231,056 entitled "Baked Goods Container", filed Jan. 14, 1999, pending, which is a continuation of U.S. patent application Ser. No. 09/041,532, entitled "Baked Goods Container", filed Mar. 12, 1998, now U.S. Pat. No. 5,912,033, the entire specifications of which are expressly incorporated herein by reference.

BACKGROUND OF THE INVENTION

1. Technical Field

The present invention relates generally to food storage and transportation, and particularly to a device for storing and transporting baked goods such as, but not limited to, cupcakes, muffins, and the like.

2. Discussion

The storage and transportation of foodstuffs has presented numerous problems to manufacturers who have attempted to develop devices to safely, securely, and economically store and transport foodstuffs, including baked goods. With respect to baked goods, there is special interest in the storage and transportation of cupcakes, muffins, and the like.

Cupcakes are generally defined as a small cake baked in a cup-like mold. Cupcakes may optionally have various fillings injected into their cores and may have various frostings or icings applied to one or more of their outer surfaces, particularly the top surface.

Cupcakes are generally circular in shape and typically have an enlarged upper portion (referred to as the top for reference purposes) and a relatively smaller lower portion (referred to as the base for reference purposes). The shape of the cupcake is largely a function of the shape of the mold in which the cupcake batter is baked. Because the cupcake batter can only rise upwardly and outwardly away from the mold, a top is usually formed on the cupcake. Additionally, because the typical cupcake mold has a truncated conical shape, the base of the cupcake invariably has a diameter less than that of the top of the cupcake. As a result of this geometric configuration, cupcakes are, to a certain extent, inherently unstable. This instability is present even when the cupcake is placed on a substantially level surface. Even a relatively slight application of force is usually sufficient to tip most cupcakes over onto their sides. Thus, the conventional storage and transportation of cupcakes has been rendered extremely difficult due to their inherent instability.

This instability presents a special problem when attempting to transport frosted cupcakes having different flavor frostings from one location (e.g., a kitchen) to a remote location (e.g., a picnic, party, or the like). Typically, the frosted cupcakes are placed in a single layer on a dish, plate, or the like. Because cupcakes have a tendency to tip over and fall rather easily, especially during transport, cupcakes having frosting of one flavor invariably come into contact with adjacent frosted cupcakes, thus intermingling the various flavors of frostings. Additionally, problems arise when attempting to transport highly decorated cupcakes. If these highly decorated cupcakes were to tip over, their aesthetic appearance would be suffer considerably. Culinary concerns aside, these problems can present a potentially serious health hazard if a person who is allergic to chocolate inadvertently consumes a cupcake that has contacted a portion of chocolate frosting from an adjacent cupcake. Additionally, a similar health hazard could occur if a diabetic person inadvertently consumes an ostensibly sugar-free frosted cupcake that has contacted a portion of sugar-containing frosting from an adjacent cupcake.

Coverings such as aluminum foil, wax paper, plastic wrap, or the like have been used in an effort to overcome this instability. However, the use of a covering may only serve to lessen the instability and not eliminate it completely. Additionally, the use of coverings has the unwanted effect of mashing the frosting down onto the side surfaces of the cupcake, making it difficult for consumers to handle the cupcake without getting frosting onto their hands. Finally, the frosting has a tendency to adhere to some types of coverings as opposed to remaining on the top surface of the cupcake, thus wasting significant amounts of frosting when the covering is removed from the cupcakes.

Additionally, some cupcakes have relatively delicate crumb toppings. A covering could have the unwanted effect of rubbing against and eventually causing the crumb topping to fall off of the cake portion of cupcake.

Another problem with the use of plates or other conventional items to store and transport cupcakes is that cupcakes tend to heavily soil any surfaces they come into contact with. This is believed to be caused by the leaching out of fatty substances (e.g., butter, oils, and the like) used in the preparation of the cupcakes. Thus, any plates, dishes, and the like need to be thoroughly cleaned of these fatty substances.

Yet another problem with the use of plates and the like to store and transport cupcakes is that usually only a single layer of cupcakes may be placed upon the plate surface, especially if the cupcakes are frosted. Two layers of unfrosted cupcakes placed upon a plate would present a highly unstable situation, as the top layer of cupcakes would have a greatly increased tendency to tip or fall due to the fact that they are disposed on a highly irregular surface (i.e., the tops of the bottom layer of cupcakes). Additionally, two layers of frosted cupcakes placed upon a plate would be highly impractical in that the frosting of the bottom layer cupcakes would adhere to the bottom of the top layer of cupcakes. Thus, a number of plates are typically needed to store and transport even relatively small amounts of cupcakes.

Therefore, there exists a need for a device for storing and transporting baked goods such as, but not limited to, cupcakes, muffins, and the like, wherein the device allows for the segregation and stabilization of the cupcakes.

It is accordingly an object of the present invention to provide a new and improved food storage and transportation device.

It is another object of the present invention to provide a new and improved food storage and transportation device that is sealable.

It is another object of the present invention to provide a new and improved food storage and transportation device having at least one removable insert, the removable insert having at least one opening for receiving and supporting at least one cupcake.

It is another object of the present invention to provide a new and improved food storage and transportation device having a plurality of removable inserts, the removable inserts having a plurality of openings for receiving and supporting a plurality of cupcakes.

It is another object of the present invention to provide a new and improved food storage and transportation device having a plurality of removable inserts, the removable inserts having a plurality of openings for receiving and supporting a plurality of cupcakes, the base of the cupcake extending through the opening and the top of the cupcake being retained above the top surface of the removable insert so as to provide stability to the cupcake during transportation.

It is another object of the present invention to provide a new and improved food storage and transportation device having a plurality of removable inserts, the removable inserts having a plurality of openings for receiving and supporting a plurality of cupcakes, wherein the openings are spaced a sufficient distance away from the adjacent opening so as to prevent adjacent cupcakes from contacting one another.

It is another object of the present invention to provide a new and improved food storage and transportation device having a plurality of removable inserts, the removable inserts having a plurality of openings for receiving and supporting a plurality of cupcakes, wherein the cupcakes are segregated from adjacent cupcakes on the same removable insert and from cupcakes on other removable inserts.

In order to overcome the aforementioned disadvantages and achieve the aforementioned objects, the present invention provides a food storage and transportation device for storing and transporting baked goods such as, but not limited to, cupcakes, muffins, and the like, in accordance with the following embodiments.

SUMMARY OF THE INVENTION

In accordance with one embodiment of the present invention, a device for storing and transporting a food item, comprises:

a container having at least one open end, inner and outer surfaces, and upper and lower portions;

at least one elongated, substantially vertically oriented support member disposed on and projecting from the inner surface of the container; and at least one removable insert having a plurality of openings for receiving the food item, the at least one insert having at least one substantially horizontally oriented engagement area for engaging the at least one support member in order to support the at least one insert.

In accordance with another embodiment of the present invention, a device for storing and transporting a food item, comprises:

a container having at least one open end, inner and outer surfaces, and upper and lower portions;

at least one elongated, substantially vertically oriented support member disposed on and projecting from the inner surface of the container, wherein the at least one support member comprises first and second portions, the second portion having a greater profile distance from the inner surface of the container than the first portion; and at least one removable insert having a plurality of openings for receiving the food item, the at least one insert having at least one substantially horizontally oriented engagement area for engaging the at least one support member in order to support the at least one insert.

In accordance with yet another embodiment of the present invention, a device for storing and transporting a food item, comprises:

a container having at least one open end, inner and outer surfaces, and upper and lower portions;

at least one elongated, substantially vertically oriented support member disposed on and projecting from the inner surface of the container, wherein the at least one support member has a substantially uniformly increasing profile distance from the inner surface of the container as the at least one support member extends from the upper portion to the lower portion of the container; and at least one removable insert having a plurality of openings for receiving the food item, the at least one insert having at least one substantially horizontally oriented engagement area for engaging the at least one support member in order to support the at least one insert.

A more complete appreciation of the present invention and its scope can be obtained from understanding the accompanying drawings, which are briefly summarized below, the following detailed description of the invention, and the appended claims.

BRIEF DESCRIPTION OF THE DRAWINGS

The same reference numerals refer to the same parts throughout the various Figures.

DETAILED DESCRIPTION OF THE INVENTION

Figure 1:
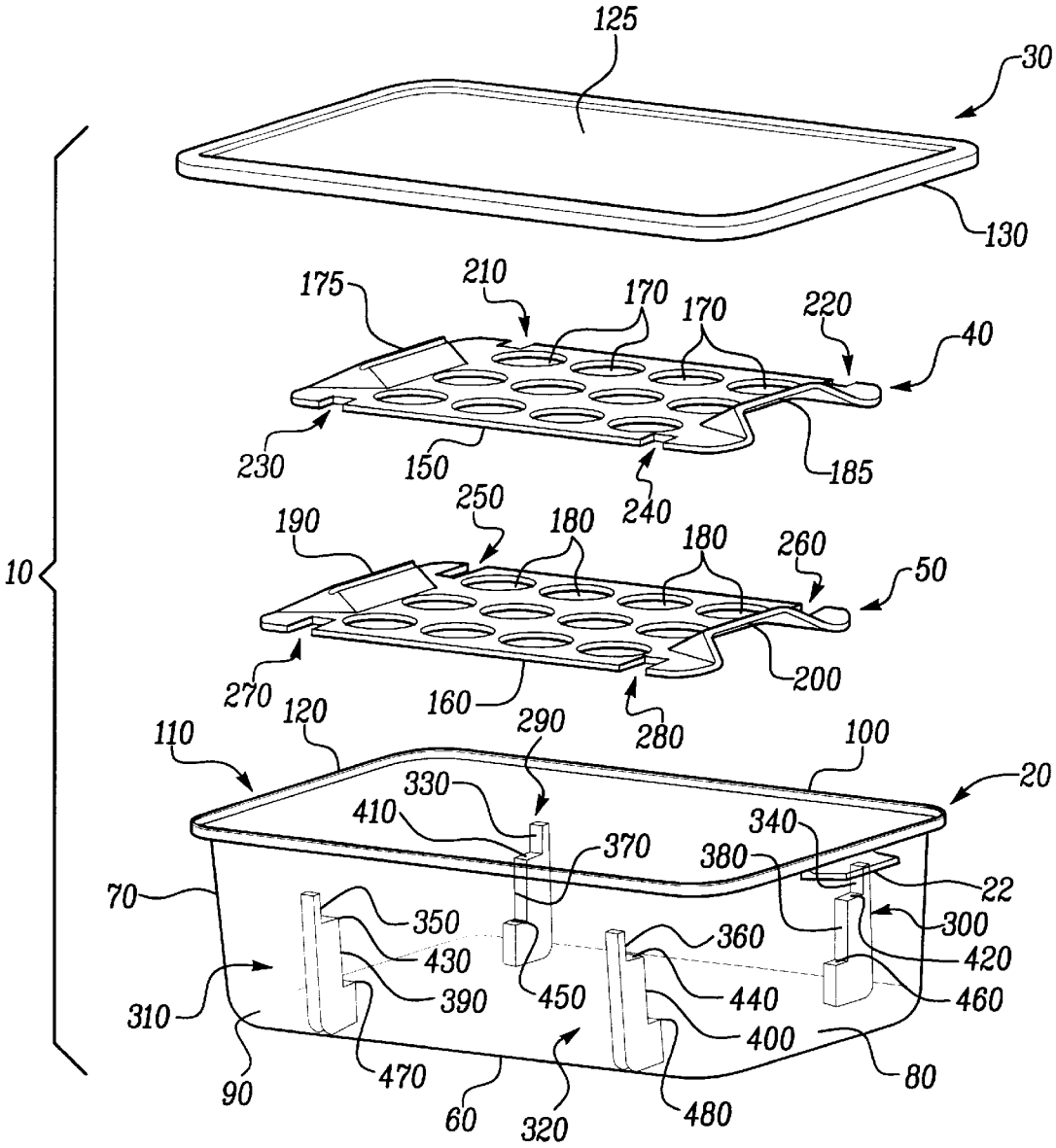
FIG. 1 is an exploded view of a device in accordance with one embodiment of the present invention.

Although primarily directed to the storage and transportation of food items such as cupcakes, the present invention can be practiced with a variety of baked goods, such as, but not limited to, muffins, and the like. Additionally, other goods besides baked goods could be stored and transported with the present invention provided that they are able to be received, supported, and retained in the openings of the removable inserts.

Referring to FIGS. 1–4, there is generally shown a device 10 for storing and transporting baked goods, such as, but not limited to, cupcakes, muffins, and the like, in accordance with one embodiment of the present invention. It should be noted that the term "cupcake" is being used synonymously for the term "baked good" throughout the instant patent application. The device 10 primarily consists of a container 20, a lid 30, and a plurality of removable inserts 40 and 50. Although two removable inserts are shown, it will be appreciated that the present invention may be practiced with only one removable insert or, alternatively, more than two removable inserts.

Device 10 can be comprised of any number of suitable materials, such as, but not limited to, thermoplastics, thermosets, metals, woods, glasses, and combinations thereof. Preferably, thermoplastic materials are employed to construct device 10 due to their relative ease of molding, low cost, light weight, low maintenance requirements, and durability. If a thermoplastic is chosen as the construction material, the primary components of device 10 can conveniently be made by the process of injection molding, or other suitable molding techniques. Injection molding is generally defined as a method of forming a plastic to the desired shape by forcing heat-softened plastic into a relatively cool cavity under pressure. By utilizing injection molding, the primary components of device 10 can conveniently be formed in essentially one step, as opposed to having to assemble individual components to one another.

Container 20, preferably having at least one open end, upper and lower portions, and inner and outer surfaces, consists primarily of a base 60, a pair of opposed and spaced endwalls 70 and 80, and a pair of opposed and spaced sidewalls 90 and 100. Although container 20 is shown as being substantially rectangular, it is envisioned that any number of suitable configurations may be employed, such as squares, rhomboids, parallelograms, circles, and the like. The interior portion of container 20 defines a cavity. The upper peripheral surface 110 of container 20 preferably defines a lip portion 120 that preferably mates with a portion of lid 30. Optionally, container 20 can be provided with a pair of spaced and opposed handles 21 and 22.

Lid 30 is a substantially planar member consisting of a base 125 and a downwardly depending wall 130 extending along the entire periphery of base 125. The configuration of lid 30 should preferably be identical to that of container 20. Thus, a rectangular container will generally be associated with a rectangular lid, a square container will generally be associated with a square lid, and so forth. A portion of downwardly depending wall 130 preferably includes a groove or recess 140 that mates with lip portion 120 of container 20 so as to establish a substantially airtight and watertight seal about lid 30 and container 20 so as to keep the cupcakes fresh and prevent them from drying out. It will be appreciated that lid 30 is not essential to practice the present invention.

Inserts 40 and 50 consist primarily of substantially planar members 150 and 160, respectively. Inserts 40 and 50 have a plurality of substantially circular apertures or openings 170 and 180, respectively, extending therethrough for receiving and retaining a plurality of baked goods such as, but not limited to, cupcakes, muffins, and the like.

Figure 2A:
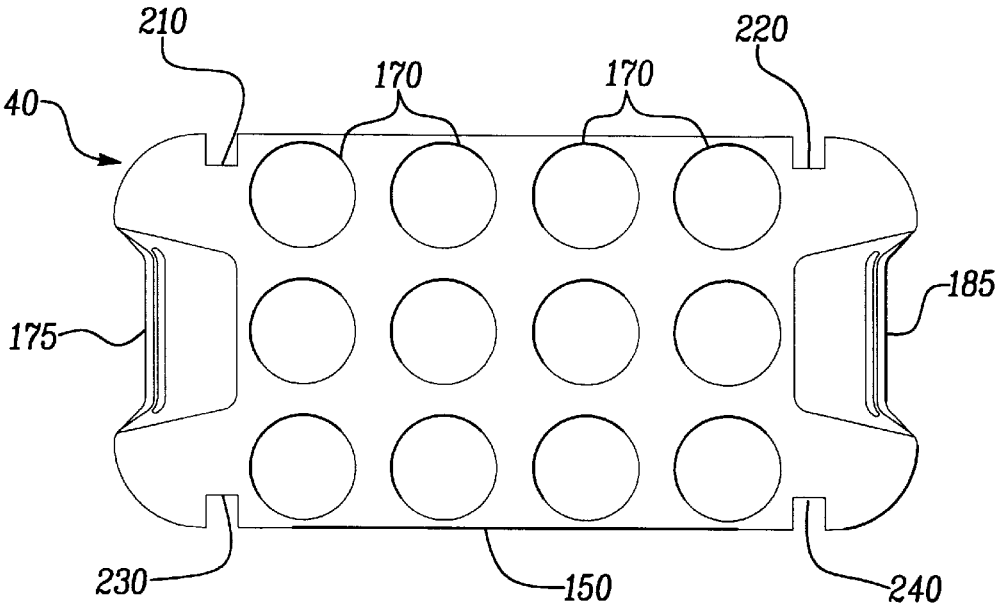
FIGS. 2A and 2B are top views of removable inserts in accordance with one embodiment of the present invention.
Figure 2B:
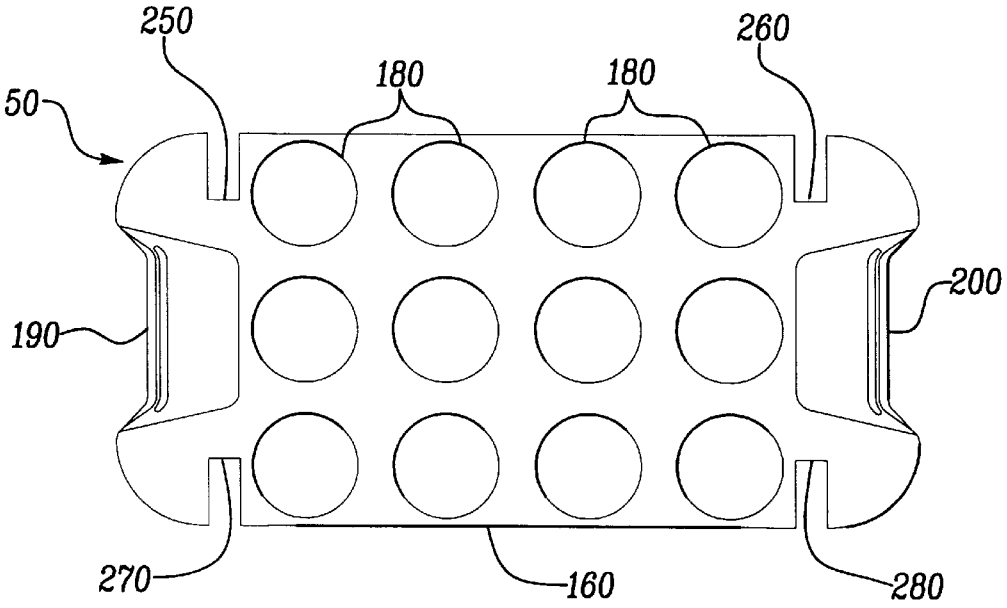

With specific reference to FIGS. 2A and 2B, although only 12 openings are illustrated, it will be appreciated that more or less than 12 openings may be provided. It will also be appreciated that only one cupcake is intended to be received and retained in each individual opening 170 and 180, respectively. It will be noted that openings 170 and 180, respectively, are spaced a sufficient distance from any adjacent opening so as to prevent one cupcake from contacting another adjacent cupcake.

Inserts 40 and 50 are preferably provided with a pair of opposed and spaced handles 175, 185 and 190, 200, respectively, that enable a user to easily grasp and lift inserts 40 and 50. Handles 175, 185 and 190, 200, respectively, are preferably raised and angled upwardly away from the top surface of inserts 40 and 50, respectively. The exact configuration of handles 175, 185 and 190, 200, respectively, is not critical provided that a user is able to easily grasp them. Additionally, the exact angle is not critical; however, an upward angle of between about 30 to about 60 degrees is preferred so as to enable a user to easily grasp them.

Inserts 40 and 50 are also provided with a plurality of substantially horizontally oriented grooves 210, 220, 230, 240 and 250, 260, 270, 280, respectively, extending radially inward towards the interior portion of inserts 40 and 50, respectively. It should be noted that grooves 210, 220, 230, and 240, respectively, extend a limited distance inwardly towards the interior of insert 40 (see FIG. 2A). Conversely, grooves 250, 260, 270, and 280, respectively, extend a greater distance inwardly towards the interior of insert 50 than those of insert 40 (see FIG. 2B). The purpose of the difference in distance between the grooves of inserts 40 and 50 will be explained herein. The grooves of the present invention are preferably oriented substantially perpendicular to the support members of the present invention. It will be appreciated that either less than or more than this number of grooves may be used to practice the present invention.

Disposed on and projecting from an interior surface of container 20 are a plurality of substantially vertically oriented elongated support members 290, 300, 310, and 320, respectively. It will be appreciated that either less than or more than this number of support members may be used to practice the present invention. Support members 290, 300, 310, and 320, respectively, comprise a series of contiguous and alternating substantially vertically oriented tab portions 330, 340, 350, 360, 370, 380, 390, and 400, respectively, and substantially horizontally oriented shoulder portions 410, 420, 430, 440, 450, 460, 470, and 480, respectively, the purpose of both of which will be explained herein. Although the orientation of the shoulder portions of the present invention are characterized as being substantially horizontal, the orientation of the support members is still properly characterized as being substantially vertical. The height of support members 290, 300, 310, and 320, respectively, are less than that of endwalls 70 and 80, respectively, and sidewalls 90 and 100, respectively, so that inserts 40 and 50, respectively, are capable of being seated securely within the cavity of container 20. It will also be noted that support members 290, 300, 310, and 320, respectively, increase in profile distance away from the inner surface of container 20 as support members 290, 300, 310, and 320, respectively, extend downwardly from the upper portion of container 20 to the lower portion of container 20.

Figure 3:
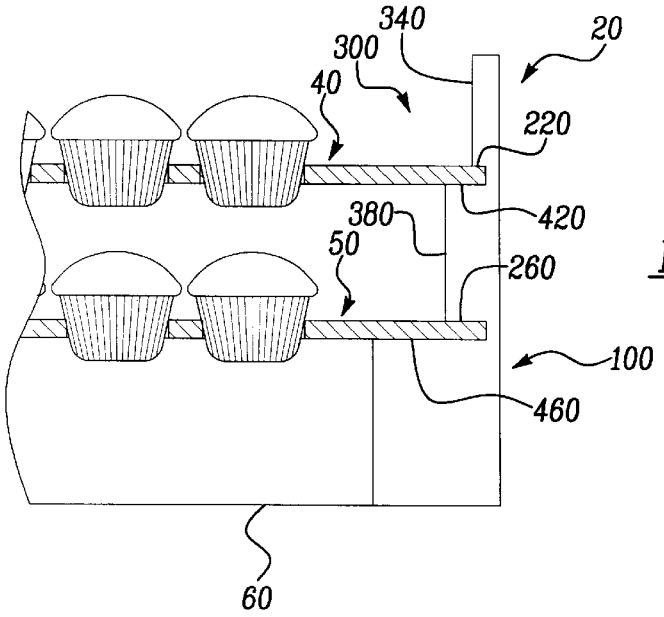
FIG. 3 is an enlarged cross-sectional view of a removable insert engaging a support member in accordance with one embodiment of the present invention.
Figure 4:
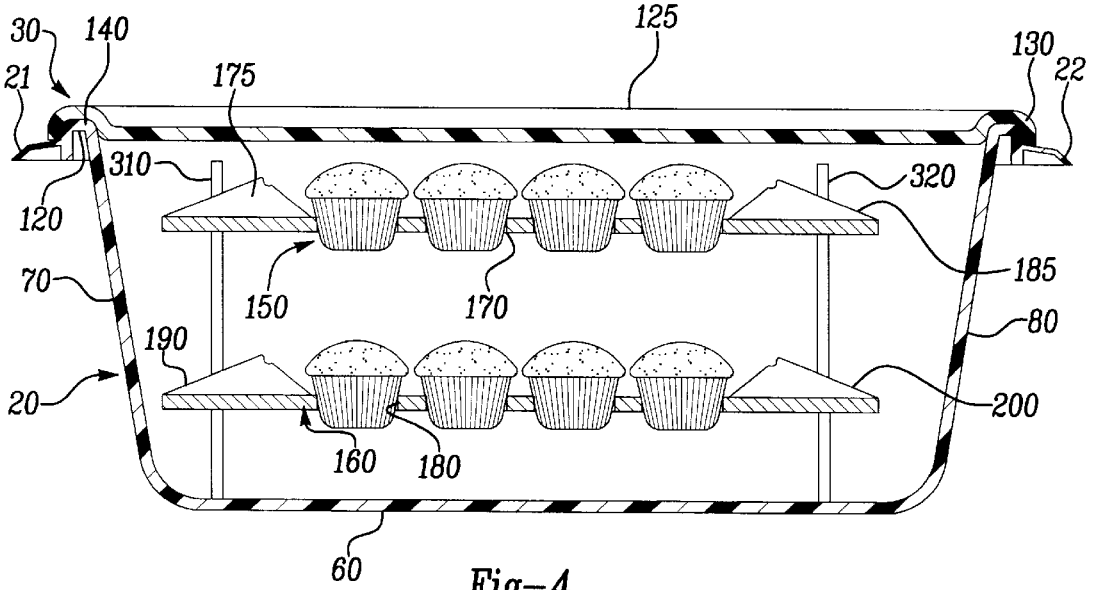
FIG. 4 is a cross-sectional view of a device in accordance with one embodiment of the present invention.

With specific reference to FIG. 3, the intended engagement of inserts 40 and 50 with support members 290, 300, 310, and 400 will now be explained in detail. If both inserts 40 and 50 are to be used, it is preferred that insert 50 be deployed into container 20 prior to insert 40, for reasons that will become apparent. Because grooves 250, 260, 270, and 280 of insert 50 are relatively long or deep as compared to those of insert 40, they can be easily received by, i.e., lowered onto and past, tab portions 330, 340, 350, and 360, respectively, shoulder portions 410, 420, 430, 440, respectively, and tab portions 370, 380, 390, and 400, respectively. However, because the depth of grooves 250, 260, 270, and 280 of insert 50 are configured to be less than the profile distance of shoulder portions 450, 460, 470, and 480, respectively, at least a portion of the lower surface of insert 50 abuts against at least a portion of a surface of shoulder portions 450, 460, 470, and 480, respectively. Thus, shoulder portions 450, 460, 470, and 480, respectively, do not allow insert 50 to descend any lower on support members 290, 300, 310, and 400, respectively, and in this manner support insert 50. Preferably, the widths of grooves 250, 260, 270, and 280, respectively, of insert 50 are only slightly wider than the widths of tab portions 330, 340, 350, and 360, respectively, shoulder portions 410, 420, 430, 440, respectively, and tab portions 370, 380, 390, and 400, respectively, so as to allow grooves 250, 260, 270, and 280, respectively, of insert 50 to frictionally engage tab portions 370, 380, 390, and 400, respectively, in order to reduce lateral movement of insert 50 during transport. The grooves and their adjacent surface (preferably lower surface) portions of the insert and the tab and shoulder portions of the support members comprise the engagement area.

With respect to the deployment of insert 40, because grooves 210, 220, 230, and 240, respectively, of insert 40 are relatively short or shallow as compared to those of insert 50, they can be only be received by, i.e., lowered onto and past, tab portions 330, 340, 350, and 360, respectively. However, because the depth of grooves 210, 220, 230, and 240, respectively, of insert 40 are configured to be less than the profile distance of shoulder portions 410, 420, 430, and 440, respectively, at least a portion of the lower surface of insert 40 abuts against at least a portion of a surface of shoulder portions 410, 420, 430, and 440, respectively. Thus, shoulder portions 410, 420, 430, and 440, respectively, do not allow insert 40 to descend any lower on support members 290, 300, 310, and 400, respectively, and in this manner support insert 40. Preferably, the widths o f grooves 210, 220, 220, and 240, respectively, of insert 40 are only slightly wider than the widths of tab portions 330, 340, 350, and 360, respectively, so as to allow grooves 210, 220, 230, and 240, respectively, of insert 40 to frictionally engage tab portions 330, 340, 350, and 360, respectively, in order to reduce lateral movement of insert 40 during transport. The grooves and their adjacent surface (preferably lower surface) portions of the insert and the tab and shoulder portions of the support members comprise the engagement area.

Figure 5:
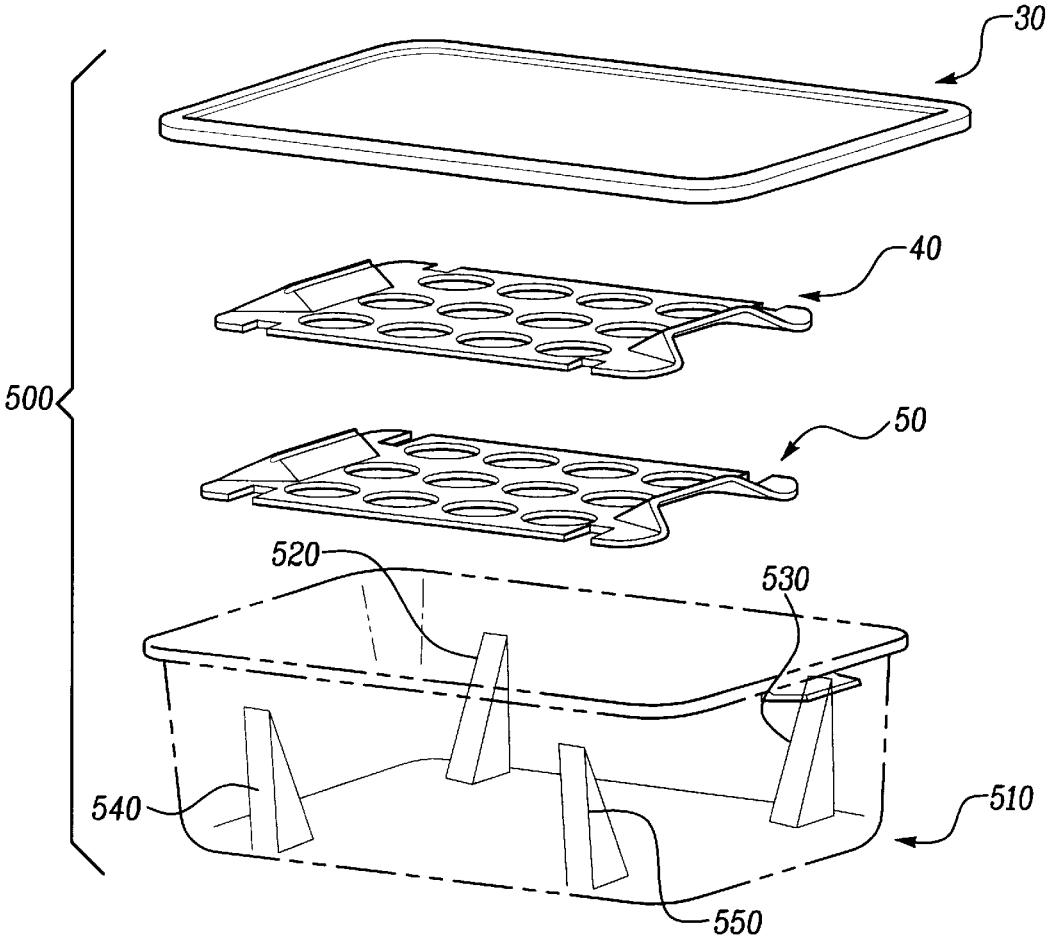
FIG. 5 is a perspective view illustrating a container having a modified support member configuration in accordance with an alternative embodiment of the present invention.
Figure 6:
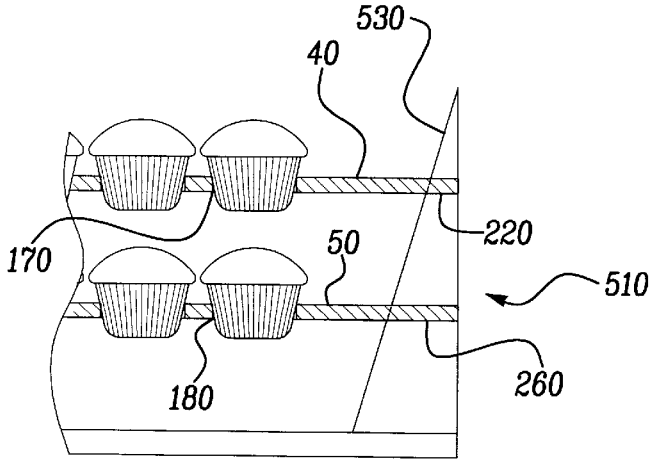
FIG. 6 is a partial broken away end-view of a device in accordance with an alternative embodiment of the present invention.

Referring to FIGS. 5–6, there is generally shown a device 500 for storing and transporting baked goods, such as, but not limited to, cupcakes, muffins, and the like, in accordance with an alternative embodiment of the present invention. The primary components of device 500 are substantially identical to those of the device illustrated in FIGS. 1–4, except for container 510. In this embodiment, support members 520, 530, 540, and 550, respectively, are generally triangular in shape and increase in profile distance away from the inner surface of container 510 as support members 520, 530, 540, and 550, respectively, extend downwardly from the upper portion of container 510 to the lower portion of container 510. In this embodiment, grooves 250, 260, 270, and 280, respectively, of insert 50 frictionally engage at least a portion of a surface of support members 520, 530, 540, and 550, respectively, so as to support insert 50. Once insert 50 reaches a certain point on the surfaces of support members 520, 530, 540, and 550, respectively, insert 50 will be prevented from descending any lower on support members 520, 530, 540, and 550, respectively, due to the fact that grooves 250, 260, 270, and 280, respectively, tightly and frictionally engage support members 520, 530, 540, and 550, respectively.

Likewise, grooves 210, 220, 230, and 240, respectively, of insert 40 frictionally engage at least a portion of a surface of support members 520, 530, 540, and 550, respectively, so as to support insert 40. Once insert 40 reaches a certain point on the surfaces of support members 520, 530, 540, and 550, respectively, insert 40 will be prevented from descending any lower on support members 520, 530, 540, and 550, respectively, due to the fact that grooves 210, 220, 230, and 240, respectively, tightly and frictionally engage support members 520, 530, 540, and 550, respectively.

In this particular embodiment, it is important that the widths of the respective grooves of both inserts 40 and 50 are only slightly wider than the widths of the respective tab portions so as to allow the grooves of both inserts 40 and 50 to tightly and frictionally engage the tab portions in order to reduce lateral, as well as horizontal, movement of the inserts during transport. In this embodiment, the grooves and the support members comprise the engagement area.

As previously described, it is intended that an individual cupcake be received and retained in each individual opening 170 and 180, respectively. With specific reference to FIGS. 4 and 6, the base of the cupcake extends freely through openings 170 and 180, respectively, whereas the top of the cupcake is prevented from extending through openings 170 and 180, respectively, due to the top's geometric configuration. Additionally, it will be appreciated that not every opening 170 and 180, respectively, need have its own individual cupcake. The present invention can be practiced with only one cupcake or a plurality of cupcakes, as well as with only one removable insert or a plurality of removable inserts. It should also be noted that inserts 40 and 50 are located directly on top of one another, i.e., they are not offset with respect to one another. This is because support members 290, 300, 310, and 320, respectively, of the present invention permit both inserts 40 and 50 to share common support members, as opposed to using two discrete and separate support member assemblies or systems. As a result of this advantage, a relatively smaller container may be used to store and transport a relatively large number of cupcakes as compared to conventional devices.

Once the desired number of cupcakes have been loaded into inserts 40 and 50, they can then be loaded into container 20. Insert 50 is loaded into container 20 first, and may therefore be referred to as the lower or bottom removable insert. Accordingly, once insert 40 is loaded into container 20, it may be referred to as the upper or top removable insert. Thus, in this manner, inserts 40 and 50 are characterized as being nestable within container 20. In accordance with one embodiment of the present invention, a first removable insert is intended to rest on a support member located in proximity to the lower portion of container 20, and a second removable insert is intended to rest on a support member located in proximity to the upper portion of container 20. It should be noted that the cupcakes of insert 50 are spaced a sufficient distance from the cupcakes of insert 40 so as to prevent the cupcakes of one insert from contacting the cupcakes of an adjacent insert. Additionally, it should be noted that the cupcakes of insert 50 are spaced a sufficient distance from base 60 of container 20 so as to avoid unwanted contact with base 60 of container 20.

Once all of the inserts are loaded, lid 30 may then be placed on container 20 so as to cover the cupcakes in order to keep them fresh and protect them from airborne dust, particles, microorganisms, and other unwanted debris. Lid 30 should not contact the cupcakes of the upper removable insert, e.g., insert 40. Device 10, with its payload of cupcakes, may be stored or transported to a remote location.

Figure 7:
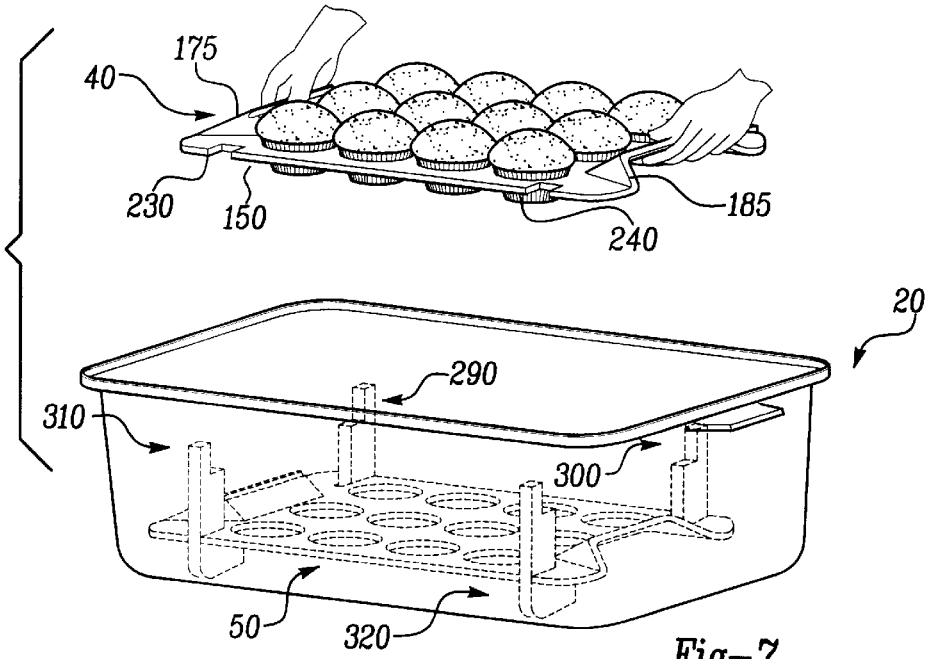
FIG. 7 is a perspective view illustrating the removal of a loaded removable insert from the container in accordance with one embodiment of the present invention.
Figure 8:
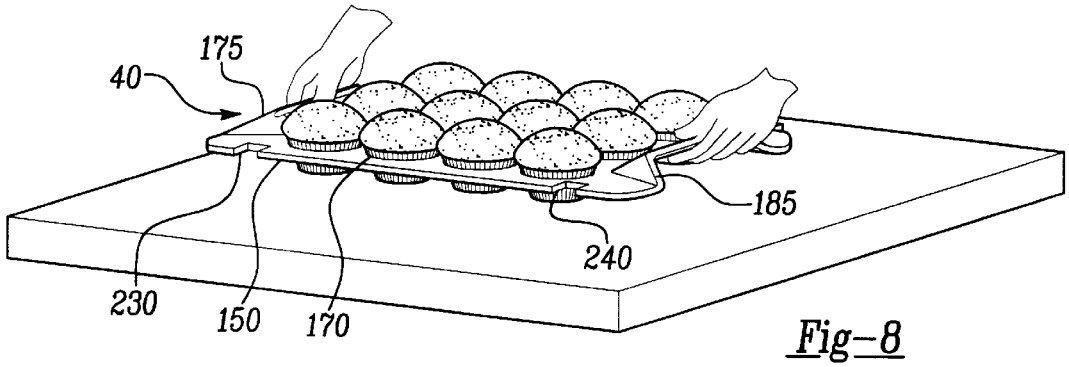
FIG. 8 is a perspective view illustrating the loaded removable insert from the container being initially placed onto a flat surface in accordance with one embodiment of the present invention.
Figure 9:
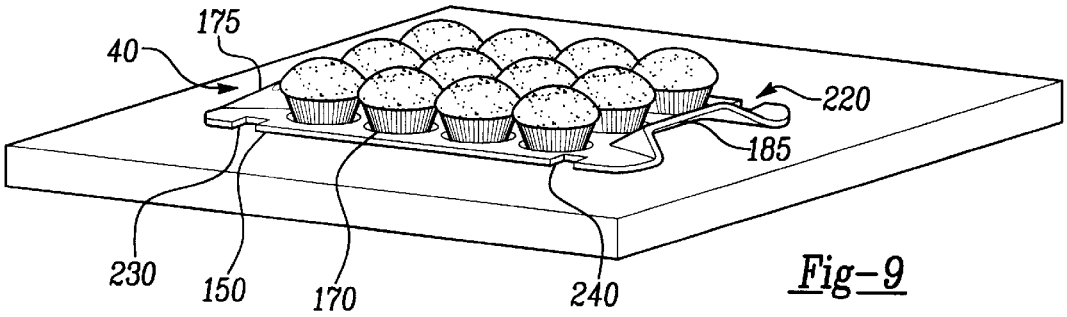
FIG. 9 is a perspective view illustrating the loaded removable insert from the container being completely and fully placed onto a flat surface whereupon the cupcakes are dislodged from their respective openings in accordance with one embodiment of the present invention.

With reference to FIGS. 7–9, the removal of the cupcakes from the removable inserts will be described in detail. Initially, lid 30 should be removed from container 20 so as to provide an operator access to the interior cavity of container 20. Referring specifically to FIG. 7, the operator then simply reaches into container 20 and grasps the first or highest loaded removable insert (in this instance, removable insert 40) by handles 175 and 185 and lifts loaded removable insert 40 upwardly out of container 20. If there are additional loaded removable inserts, they may be removed from container 20 in an identical manner. Once loaded removable insert 40 has been removed, it should be placed onto a flat, preferably stable, surface. Referring specifically to FIG. 8, when loaded removable insert 40 is initially lowered onto a flat surface, it is the base portion, specifically the bottom surface, of the cupcakes that first contact the flat surface thus imparting an upward force on the cupcakes. As loaded removable insert 40 is still further lowered onto the flat surface, the cupcakes are in effect urged further upwardly out of their respective openings 170. Referring specifically to FIG. 9, once loaded removable insert 40 contacts the flat surface, the cupcakes are completely dislodged from their respective openings 170, and are ready for immediate serving and consumption.

The foregoing description is considered illustrative only of the principles of the invention. Furthermore, because numerous modifications and changes will readily occur to those skilled in the art, it is not desired to limit the invention to the exact construction and process shown as described above. Accordingly, all suitable modifications and equivalents that may be resorted to that fall within the scope of the invention as defined by the claims that follow.

What is claimed is:

1. A device for storing and transporting a food item, comprising:

a container having at least one open end, inner and outer surfaces, and upper and lower portions;

at least one elongated, substantially vertically oriented support member disposed on and projecting from the inner surface of the container, wherein the at least one support member has a substantially uniformly increasing profile distance from the inner surface of the container as the at least one support member extends downwardly from the upper portion to the lower portion of the container; and at least one removable insert having a plurality of openings for receiving the food item, the at least one insert having at least one substantially horizontally oriented engagement area for engaging the at least one support member in order to support the at least one insert, wherein the engagement area comprises a groove, wherein the groove is perpendicular to the at least one support member, wherein the groove substantially envelopes the at least one support member, wherein at least a portion of the at least one support member extends through the groove.

2. The device of claim 1, wherein the at least one support member frictionally engages at least a portion of a surface of the engagement area of the at least one insert.

3. The device of claim 1, wherein there are two of the inserts.

4. The device of claim 3, wherein the inserts are nestable in the container, the inserts being spaced apart from one another.

5. The device of claim 1, wherein there are four of the support members.

6. The device of claim 1, wherein the container has a pair of handles.

7. The device of claim 1, wherein the at least one insert has a pair of handles.

8. The device of claim 1, wherein the food item is a baked good.

9. The device of claim 1, further comprising a lid being disposed on the top portion of the container.

* * * * *